US006098851A

United States Patent [19]

Anderson

[11] Patent Number: 6,098,851

[45] Date of Patent: Aug. 8, 2000

[54] HANDLING SYSTEM FOR AGGLOMERABLE MATERIALS

[75] Inventor: Daniel D. Anderson, Fleetwood, Pa.

[73] Assignee: Bulk Materials International, Inc., Newtown, Conn.

[21] Appl. No.: 09/258,785

[22] Filed: Mar. 1, 1999

[51] Int. Cl.[7] ..... B67D 5/06

[52] U.S. Cl. ..... 222/185.1; 222/462; 222/564

[58] Field of Search ..... 222/185.1, 460, 222/462, 426, 564, 547; 239/379

[56] References Cited

U.S. PATENT DOCUMENTS

| | | | |
|---|---|---|---|
| 2,378,553 | 6/1945 | Hornbrook . | |
| 2,685,480 | 8/1954 | Birch . | |
| 3,797,707 | 3/1974 | Jenike et al. | 222/462 X |
| 3,802,582 | 4/1974 | Brock | 222/462 X |
| 4,032,048 | 6/1977 | Nichols | 222/185.1 |
| 4,058,239 | 11/1977 | Van Mill | 222/462 |
| 4,840,284 | 6/1989 | Snyder . | |
| 4,953,752 | 9/1990 | Tousignant et al. | 222/185 X |
| 5,182,057 | 1/1993 | Johnson | 222/181 X |
| 5,445,289 | 8/1995 | Owen | 222/185.1 X |
| 5,593,067 | 1/1997 | Shaw et al. | 222/185.1 X |
| 5,626,455 | 5/1997 | Keller . | |
| 5,769,281 | 6/1998 | Bates | 222/564 X |

FOREIGN PATENT DOCUMENTS

| | | |
|---|---|---|
| 235752 | 9/1964 | Australia . |
| 536656 | 5/1922 | France . |
| 1283749 | 11/1968 | Germany . |
| 2157865 | 5/1972 | Germany . |
| 939698 | 7/1982 | U.S.S.R. . |

*Primary Examiner*—Kevin Shaver
*Assistant Examiner*—David Deal
*Attorney, Agent, or Firm*—Richard P. Gilly

[57] ABSTRACT

A handling system for agglomerable materials has a hopper with four sidewalls, each sidewall having a slope differing from each of the other sidewalls by at least 5°. The slopes are selected and the sidewalls have a length selected so that the outlet has a cross-sectional area not less than 50% of the cross-sectional area of the inlet. The handling system is well-suited for dispensing synthetic gypsum in the manufacture of Portland cement or wallboard.

8 Claims, 2 Drawing Sheets

HANDLING SYSTEM FOR AGGLOMERABLE MATERIALS

FIELD OF THE INVENTION

This invention relates to material handling systems, and more particularly to handling systems for agglomerable materials.

BACKGROUND

Certain bulk materials, although they exist in generally fluid form, are "sticky," "muddy," viscous, or coagulant, collectively referred to hereinafter as "agglomerable." One such agglomerable material is synthetic gypsum, which is highly useful in making Portland cement and wallboard. In general terms, gypsum improves the ease of manufacturing and the strength characteristics of the resultant material, whether it be Portland cement or wallboard.

Synthetic gypsum is a lower-cost replacement for naturally occurring gypsum. Such synthetic gypsum is generally produced as a byproduct from other processes which typically include high-temperature combustion. For this reason, the majority of synthetic gypsum produced in the United States is generated from coal-fired electric power generation plants. Scrubbers are utilized in such power generation plants to collect sulfur dioxide emissions generated during the coal firing process. The scrubbers utilize a filter medium material produced from limestone which is high in calcium. As the filter absorbs sulfur dioxide emissions, the filter material chemically transforms to a calcium sulfate material which is compositionally very similar to natural gypsum. Once the filter becomes spent or saturated, it is typically discarded; it is such typically discarded filters which serve as an excellent source of synthetic gypsum.

The primary drawback to utilizing synthetic gypsum has been its agglomerable characteristics. Manufacturing processes generally require the reactive or constituent materials to be evenly and easily conveyed to and from the various manufacturing apparatus involved in the material processing. Unfortunately, agglomerable materials, such as synthetic gypsum, are difficult to feed and meter reliably in such processes. In particular, synthetic gypsum is generally difficult to convey evenly and at the required rates during Portland cement and wallboard manufacturing. In such manufacturing processes, bulk materials are typically stored and dispensed from hoppers or silos. Such hoppers generally have sidewalls which slope symmetrically and inwardly from their upper edges toward the dispensing area or outlet of the hopper. This typical hopper geometry frequently causes "bridging" at or near the outlet of the hopper, which, in turn, stops flow or makes it erratic.

Even when hoppers are associated with mass flow feeders, such devices do not render the flow uniform because it has been found that the material "bridges" or agglomerates before reaching the mass flow feeders, thereby making the flow erratic.

Some hoppers have more complexly-shaped sidewalls which, in vertical cross-section, have either a curvature or a variety of slopes associated with the sidewalls. Such multiple, sloped sidewalls are nonetheless symmetrical in relation to a central, longitudinal axis of the hopper.

Other systems known in the art make use of a vertical sidewall in the hopper and an opposing angled or sloped sidewall. Examples of such structures are shown in U.S. Pat. No. 4,265,065 (Osada), U.S. Pat. No. 2,376,553 (Hombrook), and Ger. Pat. No. 1,23,749 (Harriman). The geometries of these structures render them incapable of dispensing agglomerable materials, as such materials are generally not able to pass through the outlet, and if they do, the flow is erratic and non-uniform.

There is thus a need for a handling system for agglomerable materials which can reliably and uniformly feed and meter from a hopper.

SUMMARY OF THE INVENTION

A handling system for agglomerable materials has a hopper with four sidewalls, each sidewall having a slope differing from the other sidewalls by at least 5°. The sidewalls have slopes and lengths selected so that the hopper outlet has a cross-sectional area not less than 50% of the cross-sectional area of the inlet. The handling system is well-suited for dispensing synthetic gypsum in the manufacture of Portland cement or wallboard.

In one preferred embodiment, the first sidewall is substantially vertical, the second sidewall slopes at an angle with the horizontal in the range of about 75° to about 85°, and the third and fourth sidewalls have slopes ranging between about 60° and about 80°. The dissimilar angles of the sidewalls deflect the flow of synthetic gypsum loaded in the hopper, and thereby reduce bridging and erratic flow.

BRIEF DESCRIPTION OF THE DRAWING

The invention will be better understood by reference to the attached drawing. It is understood that the drawing is for illustrative purposes only and is not necessarily drawn to scale. In fact, certain features of the present invention are shown in more detail for purposes of explanation and clarification. The drawing includes.

DESCRIPTION OF THE PREFERRED EMBODIMENT

Figure 1:
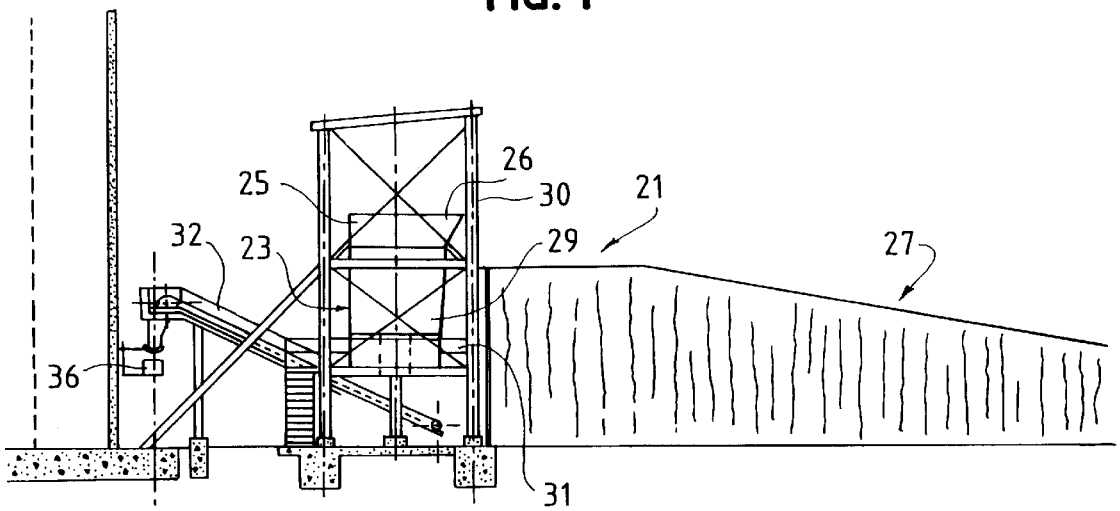
FIG. 1 is a schematic view of an apparatus for making Portland cement in accordance with the present invention.

Referring now to the drawing, and in particular to FIG. 1, an apparatus 21 for making Portland cement according to the present invention includes a hopper 23 for dispensing synthetic gypsum. The hopper 23 is specially structured with no two sidewalls the same, as detailed below, a structure which has been found to reduce bridging or other erratic flow of the synthetic gypsum.

Figure 2:
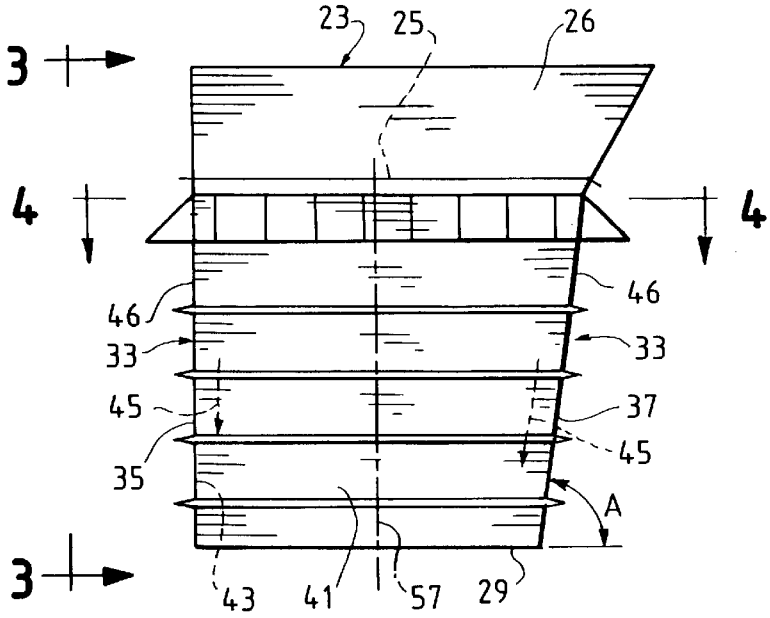
FIG. 2 is a first, side-elevational view of the inventive hopper shown schematically in FIG. 1.
Figure 3:
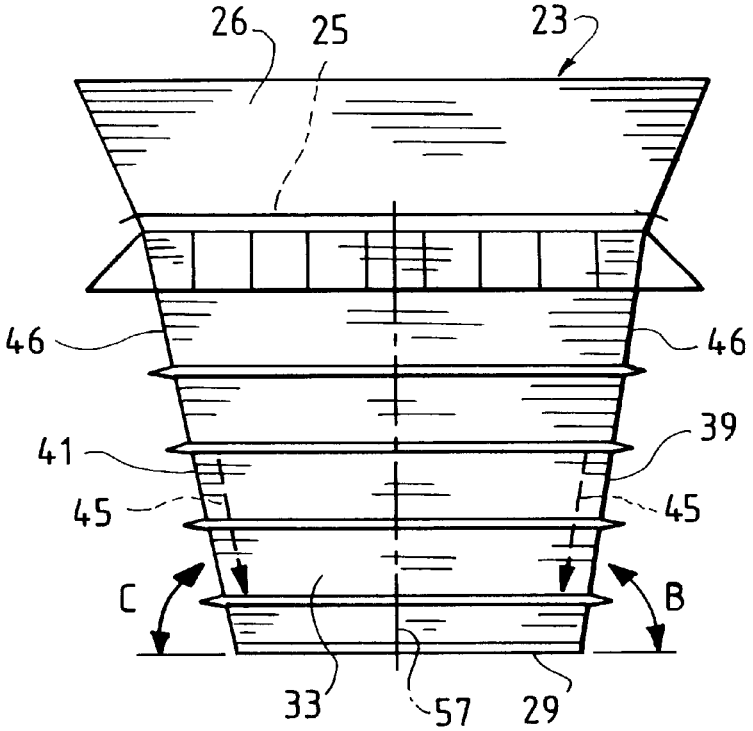
FIG. 3 is a second, side-elevational view of the hopper of FIG. 2.
Figure 4:
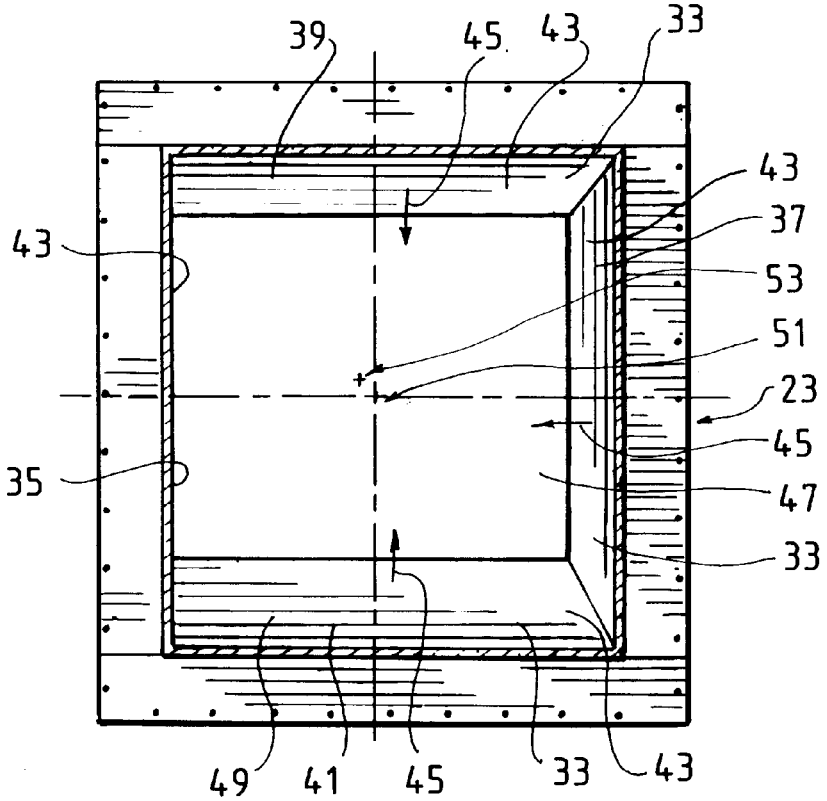
FIG. 4 is a top sectional view of the hopper of FIGS. 2 and 3, taken along line 4—4 of FIG. 2.

The synthetic gypsum is transported to apparatus 21 by carrying a load of it up ramp 27. The synthetic gypsum is loaded into hopper 23 through inlet 25. Hopper 23 is positioned with inlet 25 vertically above outlet 29 and is secured in place by a suitable support structure 30. The force of gravity and the action of mass flow feeder 31 withdraws and meters the synthetic gypsum from outlet 29. During withdrawal from hopper 23, the agglomerable material is guided, deflected, or influenced by the dissimilar hopper sidewalls 33. After exiting outlet 29, a suitable collection conveyor 32 moves the synthetic gypsum to the next processing apparatus 36. Processing apparatus 36 preferably includes a suitable mill for grinding and combining the synthetic gypsum with clinker to create Portland cement in powder form, such cement having enhanced strength characteristics. Referring now to FIGS. 2–4, hopper 23 has been provided with four sidewalls 33 which are advantageously configured to reliably and evenly feed agglomerable material such as synthetic gypsum therethrough. Each of the sidewalls 33 has an outer surface 44 and an inner surface 43. Inner surfaces 43 are substantially planar and extend generally parallel to corresponding outer surfaces 44.

Referring in particular to FIG. 2, a first sidewall 35 is oriented substantially vertically. A second sidewall 37, opposite the first sidewall, slopes toward the outlet 29, preferably at an angle with the horizontal in the range of about 75° to about 85°, and most preferably at angle A of about 80°. The third and fourth opposite sidewalls 39, 41 (FIG. 3) slope toward the inlet 25 at angles B, C with the horizontal ranging between about 60° and about 80°, the third sidewall 39 preferably having an angle B of about 75° and the fourth sidewall 41 preferably having an angle C of about 70°. It is understood that, in this embodiment the inner surfaces 43 of the sidewalls 33 have slopes corresponding to those enumerated above with respect to the sidewalls themselves.

What is significant about the above geometry is that the slopes of the sidewalls 33 are selected so that the angle of each sidewall is dissimilar from the angles of each of the other sidewalls by at least 5°. This dissimilarity, in turn, makes hopper 23 asymmetric in its vertical cross-section, that is, asymmetric about vertical axis 57 as shown in FIGS. 2 and 3. Furthermore, the cross-sectional area of inlet 25 has a centerpoint 51 which is laterally spaced from the corresponding centerpoint 53 of outlet 29 (FIG. 4). A crown 26, also with sloping sidewalls, is formed above inlet 25 to help with the retention and feeding of the appropriate load of material in hopper 23.

Besides the asymmetric, dissimilar sidewalls 33 discussed above, another important feature of the present invention is to give outlet 29 a cross-sectional area 47 preferably no less than about 50% of the cross-sectional area 49 of inlet 25. The ratio of cross-sectional areas 47, 49 deflects a sufficient amount of synthetic gypsum, but not so much as to cause bridging.

In the illustrated embodiment, hopper 23 is a 75-ton hopper with sidewalls 33 having slopes as described above. The vertical distance between the inlet 25 and outlet 29 of hopper 23 ranges from about 9 feet to about 40 feet, and preferably is about eleven feet. In such configuration, the inlet is about 11'11" by 13'¼" and the outlet is about 8'11" by 10'7". The inlet area thus is about 156 sq. ft. and the outlet area is about 94 sq. ft, or about 60% of the inlet area.

Mass flow feeder 31 is preferably a rotational, screw-type conveyor, such as triple 124E feeder available from J. C. Steele & Sons. The mass flow feeder 31 includes multiple, side-by-side rollers with interengaging teeth conveying the synthetic gypsum from outlet 29 to collection conveyor 32 at a specified rate.

Although hopper 23 is illustrated in the context of feeding synthetic gypsum in a Portland cement manufacturing process, it will be appreciated by those skilled in the art that it is also useful in wallboard manufacturing, or with other agglomerable materials in still other manufacturing processes.

The advantageous operation of the present invention is apparent from the foregoing description. Agglomerable material is loaded through inlet 25 in sufficient amounts so that a substantial portion of the material either encounters, or is influenced by, at least one of the sloped sidewalls 33 prior to exiting the outlet 29. When the agglomerable material contacts or is influenced by the inner surfaces 43 of sidewalls 33 (FIG. 4), the differently sloped sidewalls 33 guide and deflect the agglomerable material along differently oriented vectors 45 toward outlet 29. The differently oriented vectors 45 create a cascading effect which has been found to reduce bridging and other agglomeration of the materials which would otherwise result in erratic flow.

Otherwise stated, by having each of the four sidewalls 33 sloped at an angle at least 5° different from each of the other sidewalls, a greater number of differently oriented forces are imparted to the agglomerable material, thereby reducing bridging and other erratic flow. As a result, the agglomerable material is fed evenly into mass flow feeder 31, which in turn meters the material onto collection conveyor 32. In the illustrated embodiment, the agglomerable material, that is, synthetic gypsum, is added to clinker and further processed into Portland cement.

In addition to the advantages apparent from the foregoing description, the present invention allows a difficult-to-handle material, that is, synthetic gypsum, to be more readily used in associated manufacturing processes, such as those used to manufacture Portland cement.

A further advantage is that the hopper according to the present invention can be readily substituted for prior art hoppers into existing designs for manufacturing facilities.

Yet another advantage is that agglomerable materials are kept flowing evenly and reliably and thus can become more widely used, an advantage which is especially significant when agglomerable materials are cheaper than materials currently in use.

It is understood that the above-described preferred embodiment is but one illustration of the present invention, and that alternative embodiments may be devised by those of ordinary skill in the art. Such alternatives, as well as others which skill or fancy may suggest, are considered to fall within the scope of the current invention, which is solely defined by the claims appended hereto.

What is claimed is:

1. A handling system for synthetic gypsum, comprising:

four sidewalls with substantially planar inner surfaces, the inner surfaces having opposing side edges joined to each other at different angles to define a hopper with no two inner surfaces having the same angle with horizontal, the sidewalls terminating in an upper edge and an opposite lower edge;

an inlet defined at the upper edge formed by the sidewalls;

an outlet defined at the lower edge formed by the sidewalls, the cross-sectional area of the outlet being about 60% of the cross-sectional area of the inlet; and a mass flow feeder having conveying rollers with interengaging teeth operatively positioned below the outlet to withdraw the synthetic gypsum from the outlet at a specified rate.

2. The handling system of claim 1, wherein the first inner surface is oriented substantially vertically, the second inner surface is opposite the first inner surface and is sloped toward the outlet at an angle with horizontal in the range of about 75° to about 85°, and the third and fourth inner surfaces slope toward the outlet at angles with horizontal in the range of about 60° to about 80°, and wherein the slopes of the inner surfaces are selected from said ranges so that the angle of each inner surface is dissimilar from the angles of each of the other inner surfaces by at least about 5°, the dissimilar slopes making the hopper asymmetric about any vertical cross-section, thereby reducing bridging and erratic flow of the synthetic gypsum.

3. A handling system for agglomerable materials, comprising:

four sidewalls joined at opposing side edges to define a hopper of quadrilateral, transverse cross-section, the sidewalls terminating in an upper edge and an opposite lower edge;

an inlet defined at the upper edge formed by the sidewalls;

an outlet defined at the lower edge formed by the sidewalls, the cross-sectional area of the outlet being no less than about 50% of the cross-sectional area of the inlet;

the four sidewalls comprising:

a first sidewall oriented substantially vertically;

a second sidewall opposite the first sidewall, sloping toward the outlet at an angle with horizontal in the range of about 75° to about 85°; and third and fourth opposite sidewalls sloping toward the outlet at angles with horizontal in the range of about 60° to 80°;

the slopes of the sidewalls being selected from said ranges so that the angle of each sidewall is dissimilar from the angles of each of the other sidewalls by at least about 5°, the dissimilar slopes making the hopper asymmetric about any vertical cross-section, thereby reducing bridging and erratic flow of the agglomerable materials.

4. The system of claim 3, wherein the second sidewall has a slope of about 80°, the third sidewall has a slope of about 75°, and the fourth sidewall has a slope of about 70°.

5. An apparatus for making Portland cement with the aid of synthetic gypsum, the apparatus comprising:

four sidewalls joined at opposing side edges to define a hopper of quadrilateral, transverse cross-section, the sidewalls terminating in an upper edge and an opposite lower edge;

an inlet defined at the upper edge formed by the sidewalls;

an outlet defined at the lower edge formed by the sidewalls, the cross-sectional area of the outlet being no less than about 50% of the cross-sectional area of the inlet;

the four sidewalls comprising:

a first sidewall oriented substantially vertically;

a second sidewall opposite the first sidewall, sloping toward the outlet at an angle with horizontal of 80°;

third and fourth opposite sidewalls sloping toward the outlet at angles with horizontal in the range of about 75° and 70°, respectively;

means for loading the hopper at a sufficient rate to cause the synthetic gypsum to be deflected by at least one of the sloped sidewalls prior to exiting the outlet;

a mass flow feeder operatively positioned below the outlet;

means for receiving the synthetic gypsum for further processing to create Portland cement.

6. The apparatus of claim 5, wherein the mass flow feeder comprises a counter-rotational, screw-type conveyor having a plurality of rollers with interengaging teeth, the rotation of the interengaging teeth conveying the synthetic gypsum from the outlet to the receiving means.

7. The apparatus of claim 6, wherein the vertical distance between the outlet and the inlet of the hopper ranges from about 10 feet to about 40 feet.

8. The apparatus of claim 6, wherein the vertical distance between the outlet and the inlet of the hopper is about 11 feet, wherein the area of the inlet is about 156 sq. ft. and the area of the outlet is about 94 sq. ft, whereby the area of the outlet is about 60% of the area of the inlet.

* * * * *